US005103432A

United States Patent [19]

Percy

[11] Patent Number: 5,103,432

[45] Date of Patent: Apr. 7, 1992

[54] EXPENDABLE SOUND SOURCE

[75] Inventor: Joseph L. Percy, Islamorada, Fla.

[73] Assignee: The United States of America as represented by the Secretary of the Navy, Washington, D.C.

[21] Appl. No.: 639,843

[22] Filed: Jan. 10, 1991

[51] Int. Cl.[5] ..... H04R 15/00

[52] U.S. Cl. ..... 367/172; 367/174

[58] Field of Search ..... 367/2-4, 367/18, 141, 142, 148, 167, 172, 174; 181/110, 113, 402; 441/9, 10, 28-30

[56] References Cited

U.S. PATENT DOCUMENTS

| | | | |
|---|---|---|---|
| 2,758,203 | 7/1956 | Harris | 250/17 |
| 3,000,216 | 9/1961 | Peters et al. | 73/398 |
| 3,126,559 | 3/1964 | Alexander | 9/10 |
| 3,262,093 | 7/1966 | Junger et al. | 340/10 |
| 3,345,607 | 10/1967 | Nelkin et al. | 340/8 |
| 3,436,776 | 4/1969 | Davis | 9/8 |
| 3,567,562 | 3/1971 | Gordon et al. | 161/7 |
| 3,854,116 | 10/1971 | Toulis et al. | 340/8 L |
| 4,034,693 | 7/1977 | Challenger | 114/16 E |
| 4,183,422 | 1/1980 | William | 181/173 |
| 4,384,351 | 5/1983 | Pagliarini, Jr. et al. | 367/175 |
| 4,420,826 | 12/1983 | Marshal, Jr. et al. | 367/167 |
| 4,507,093 | 3/1985 | Norvell | 441/2 |
| 4,524,693 | 6/1985 | McMahon et al. | 367/167 |
| 4,541,079 | 9/1985 | Thigpen | 367/19 |

*Primary Examiner*—Brian S. Steinberger

*Attorney, Agent, or Firm*—Harvey Fendelman; Thomas Glenn Keough

[57] ABSTRACT

A low frequency, high powered underwater sound source includes a housing having disposed therein, a loudspeaker, a bladder disposed over the loudspeaker for containing a pressurized non-liquid sound transmission medium, a fill system for filling the bladder with a sound transmission medium, a vent system for venting the bladder of a sound transmission medium, a differential pressure sensor for comparing the pressure in the bladder with the ambient underwater pressure, a signal generating system to generate an acoustic signal at the loudspeaker, and a control system for controlling operation of the fill system, the vent system, the differential pressure sensor and the signal generating system.

24 Claims, 11 Drawing Sheets

EXPENDABLE SOUND SOURCE

STATEMENT OF GOVERNMENT INTEREST

The invention described herein may be manufactured and used by or for the government of the United States of America for governmental purposes without the payment of any royalties thereupon or therefor.

CROSS-REFERENCE TO RELATED APPLICATIONS

This patent application contains material related to information in the following co-pending United States patent applications:

U.S. patent application Ser. No. 07/227,937, filed July 29, 1988 for "PRESSURE COMPENSATED TRANSDUCER SYSTEM WITH CONSTRAINED DIAPHRAGM", Inventor: Joseph L. Percy; and U.S. patent application Ser. No. 07/227,976, filed July 29, 1988 for "CONSTRAINED DIAPHRAGM TRANSDUCER", Inventor: Joseph L. Percy.

BACKGROUND OF THE INVENTION

The field of the present invention is underwater sound sources, and more particularly, expendable sound sources which can be launched from ships, aircraft or submarines, and still more particularly, expendable sound sources which can provide low frequency, high powered underwater acoustic signals.

The high cost of towing large acoustic sound sources from vessels during an underwater acoustic measurement exercise is known. Present high frequency, low power sources such as the sonobuoy and SUS charge type sound source are restricted in their use because of an inability to provide low frequency, high power acoustic signals and because such sources operate at only a limited number of discrete operating depths.

Accordingly, a need exists for an inexpensive omnidirectional, low frequency, high powered expendable sound source that could be launched from ships, aircraft or submarines, and operated at a plurality of depths limited only by the crush depth of the source's internal components.

SUMMARY OF THE INVENTION

An objective of the present invention is to provide a self contained underwater sound source having an air fill, vent and pressurization system and an acoustic generating system.

A further objective of the present invention is to provide a self contained underwater sound source having a control system to control the air fill, vent and pressurization system, and the acoustic generating system.

A still further objective of the present invention is to provide a computer controlled underwater sound source.

A still further objective of the present invention is to provide a computer controlled underwater sound source that includes a program to delay turn-on during rigging time.

A still further objective of the present invention is to provide a computer controlled underwater sound source that includes a program to delay turn on for a fixed period of time or until a given time to start, and also to prevent turn on of the acoustic system until the unit has reached a predetermined depth and differential pressure setting.

A still further objective of the present invention is to provide a computer controlled underwater sound source that includes a program to generate a CW frequency, step through a set of preset frequencies or run a frequency sweep.

A still further objective of the present invention is to provide a computer controlled underwater sound source that includes a program to vary signal on-time, signal off-time, and frequency increments during linear sweeps.

A still further objective of the present invention is to provide a computer controlled underwater sound source that includes a program to vary the differential pressure setting and allowable range of differential pressure.

A still further objective of the present invention is to provide a computer controlled underwater sound source using paged Eproms to contain control programs and to boot and start the computer.

In accordance with the above objectives, there is provided a low frequency, high power underwater sound source having a housing. The housing cabins a loudspeaker, a bladder disposed over the loudspeaker for containing a pressurized non-liquid sound transmission medium, a fill system for filling the bladder with a sound transmission medium, a vent system for venting the bladder of a sound transmission medium, a differential pressure sensing system for comparing the pressure in the bladder with an ambient underwater pressure, a signal generating system to generate acoustic signals at the loudspeaker, and a control system for controlling operation of the fill system, the vent system, the differential pressure sensing system, and the signal generating system.

BRIEF DESCRIPTION OF THE DRAWING

The objects, advantages and features of this invention will be more readily appreciated when read in conjunction with the accompanying drawings, in which.

DETAILED DESCRIPTION OF THE PREFERRED EMBODIMENTS

Figure 1:
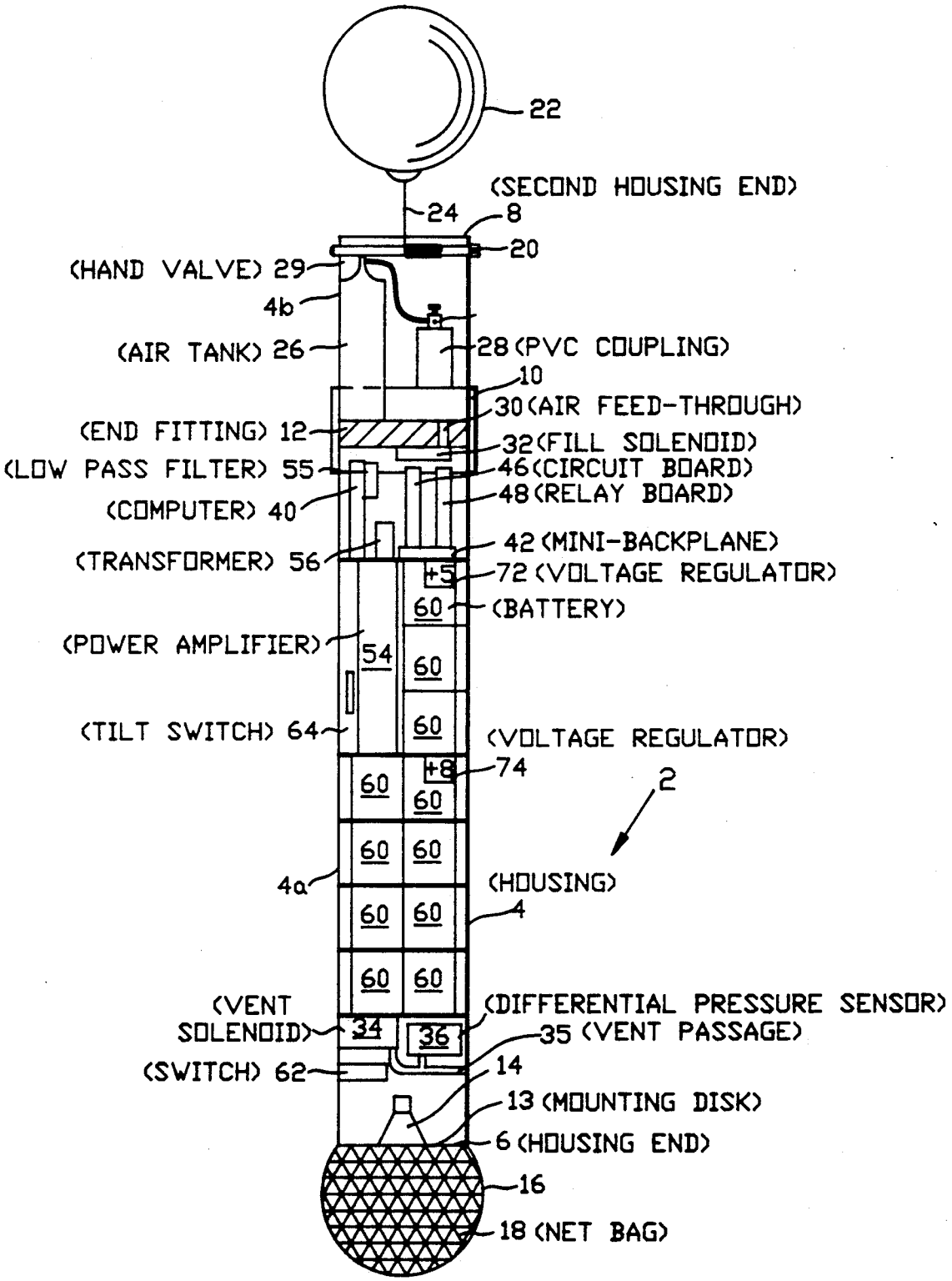
FIG. 1 is a side cross-sectional diagrammatic view of the components of an underwater sound source constructed in accordance with the present invention.

Referring now to FIG. 1, a low frequency, high power underwater sound source includes a generally cylindrical housing 4 having a first end 6, a second end 8 and a central body portion between each end. The housing 4 may be conveniently formed from eight inch diameter PVC pipe stock; it is divided into two sections 4*a* and 4*b*, which are joined by a PVC coupling 10. The lower section 4*a* is constructed to be substantially airtight. It is sealed at its upper end with an end fitting 12. It is sealed at its lower end with an annular speaker mounting disk 13. The lower section 4a may be selected to be about sixty-five inches in length. The end fitting 12 and speaker mounting disk 13 ma be conveniently formed from machined PVC stock. They are cemented in place within the lower cylindrical housing section 4a at the ends thereof.

The upper cylindrical housing section 4b is designed to be open to the underwater environment. It may be formed from a thirty-five inch length of eight inch diameter PVC stock. One end of the section 4b is coupled with the lower section 4a through the coupling 10. The other end of section 4b is open.

A loudspeaker 14 is mounted to the speaker mounting disk 13, which conveniently includes a speaker aperture (not shown) such that acoustic signals from the loudspeaker may be directed outwardly from the housing. The loudspeaker 14 may be a 60 watt 6 ½ inch woofer loudspeaker. There is further disposed over the housing end 6 an expandable elastic diaphragm or bladder 16. The bladder 16 may be a rubber balloon which is attached with electrical tape or otherwise suitably secured to the periphery of the housing end 6. The bladder 16 is preferably covered with a net bag 18 to increase the stiffness of the bladder material and limit the expansion thereof. The net bag 18 may be conveniently formed from a synthetic material such as nylon, and is secured to the periphery of the housing end 6 with nylon ties and stainless steel hose clamps or other suitable equivalents. The speaker mounting disk 13 further includes a 5/32 inch hole (not shown) to allow air to exchange between both sides of the loudspeaker. The hole is small enough that the air pressure will be the same on both sides of the loudspeaker, but is too small to allow the acoustic signal from the front of the loudspeaker to pass behind the loudspeaker so as to be out of phase with the signal from the front. The bladder 16 is inflated with pressurized air from the housing 4 through the hole in the speaker mounting disk 13. Thus, the bladder 16 provides a non-liquid sound transmission medium at the end of the loudspeaker 14.

The second housing end 8 has mounted thereon an inflation device attachment bolt 20 to which may be secured a flotation device such as the buoy 22. The buoy 22 is attached to the attachment bolt 20 by a suspension cable 24.

The upper housing section 4b includes a source of pressurized gas such as a 3,000 psi sixty-five cubic foot scuba air tank 26. The housing section 4b further includes a dome loaded differential pressure regulator 28 that is operatively connected to the output of the air tank 26 through a hand valve 29. The differential pressure regulator 28 outputs through an air feed-through 30 in the machined end fitting 12 to a fill solenoid 32. Operation of the fill solenoid 32 causes pressurized gas to fill the housing 4 and the inflatable bladder 16.

There is further provided, proximate the first housing end 6, a vent solenoid 34 that vents gas from the housing 4 through a vent passage 35 to the outside environment. There is additionally provided, proximate the housing end 6, a differential pressure sensor 36 that compares the internal housing pressure and the outside ambient water pressure and outputs an electrical signal representing the pressure differential. The differential pressure sensor 36 communicates with the ambient environment through the vent passage 35.

Figure 2:
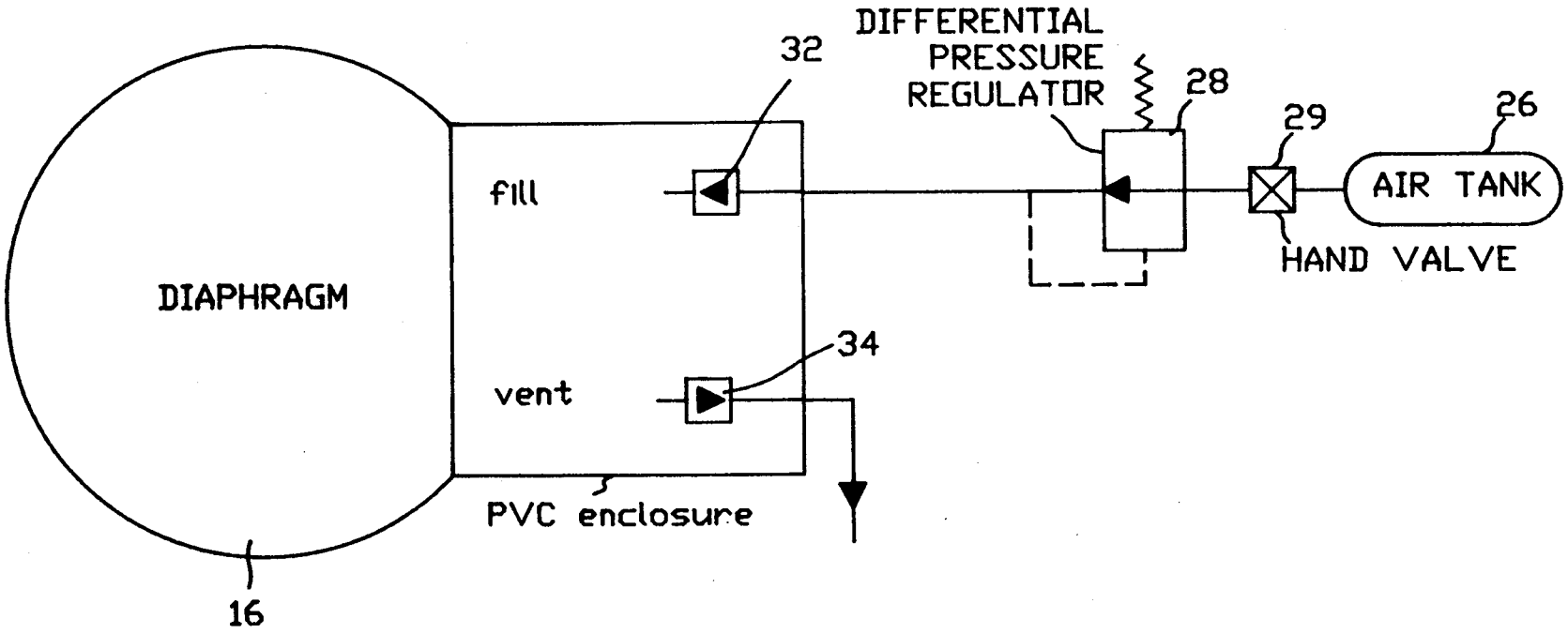
FIG. 2 is a schematic representation of the air compensation system of the underwater sound source shown in FIG. 1.

Referring now to FIG. 2, the air compensation system is shown in a schematic representation. The system includes the above-described gas fill and vent system for pressurizing and depressurizing the housing 4 and the diaphragm 16.

Figure 3:
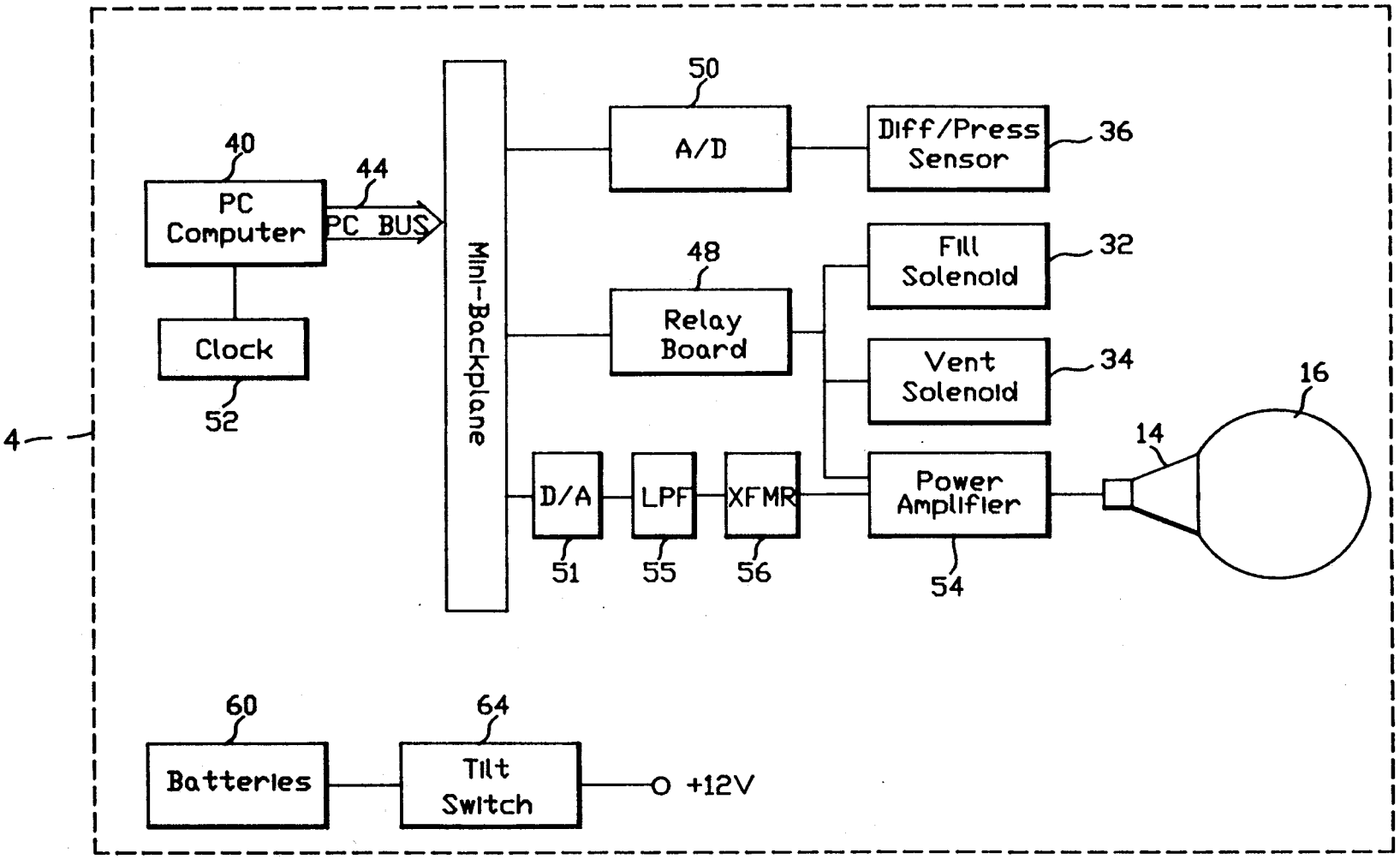
FIG. 3 is a block diagram showing the functional layout of various systems of the underwater sound source of FIG. 1.

Referring again to FIG. 1 and in addition, to FIG. 3, the operation of the fill solenoid 32, the vent solenoid 34, the differential pressure sensor 36 and the loudspeaker 14 are all controlled through a board-mounted/PC computer 40. The computer 40 operates a mini-backplane 42 through a conventional PC bus 44. There is electrically and physically connected to the mini-backplane 42, a circuit board 46 and a relay board 48. The circuit board 46 includes an analog/digital converter (50 in FIG. 3) and a digital/analog converter (51 in FIG. 3). Although not illustrated in FIG. 1, the computer 40 includes a plug-in module on which is mounted a conventional digital clock circuit 52. The computer 40 and mini-backplane are available from Ampro. The circuit board 46 may be obtained from Industrial Computer Source under product number AI08.

In FIG. 3, the analog/digital converter 50 receives an analog signal output from the differential pressure sensor 36. That signal represents the difference between the internal housing gas pressure and the external water pressure. The analog/digital converter 50 converts this analog signal into a pressure differential signal in the form of a digital signal that is fed to the computer 40.

The clock 52 is used by the computer in generating an acoustic drive signal in the form of a square wave of a computer-determined or preset frequency. The square wave is fed to a digital/analog convertor (D/A) 51 which converts it to an analog signal. The converted analog signal is fed through a low pass filter (LPF) 55, a transformer 56, and then to a power amplifier 54. The analog signal is amplified by the power amplifier 54 and fed therefrom to the loudspeaker 14. In response to the amplified analog signal, the loudspeaker 14 provides an acoustic output into the water through the net covered bladder 16.

As discussed in more detail below, the relay board 48 includes relays that power the fill solenoid 32, the vent solenoid 34, and the power amplifier 54.

Figure 4:
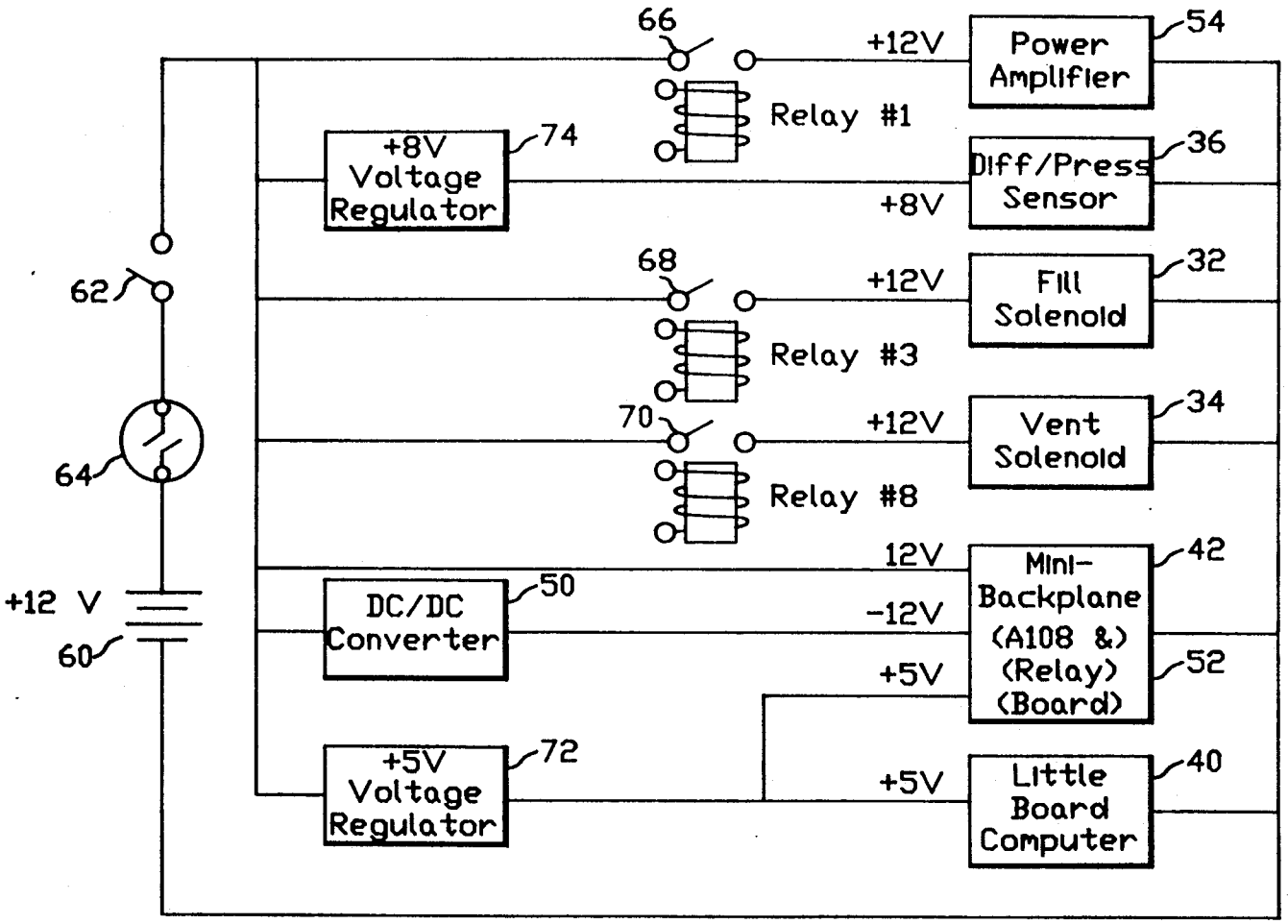
FIG. 4 is a block wiring diagram of the underwater sound source of FIG. 1.
Figure 5A:
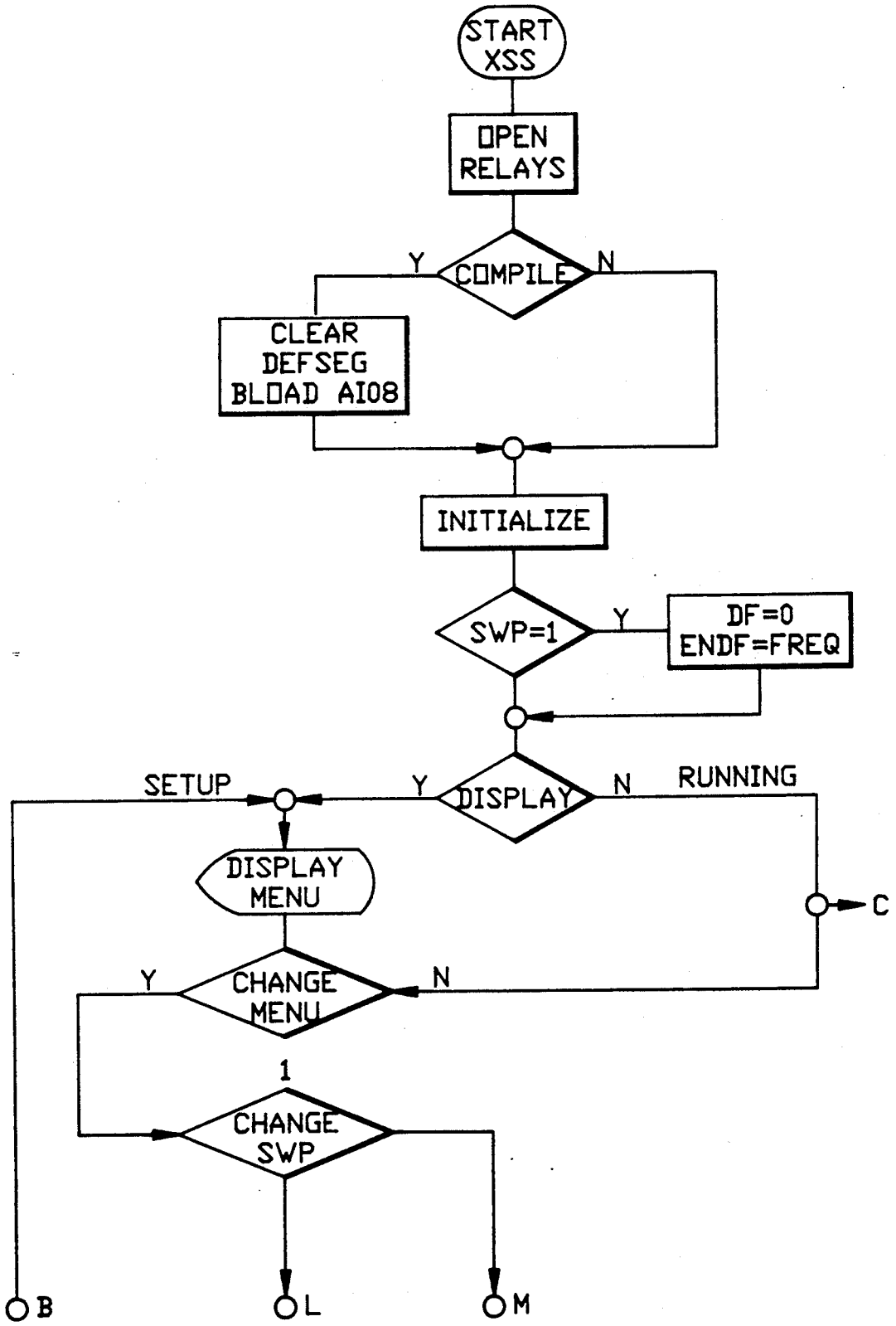
FIG. 5 is a block flow diagram including FIGS. 5*a*–5*g* showing a programming sequence for controlling the underwater sound source of FIG. 1.
Figure 5B:
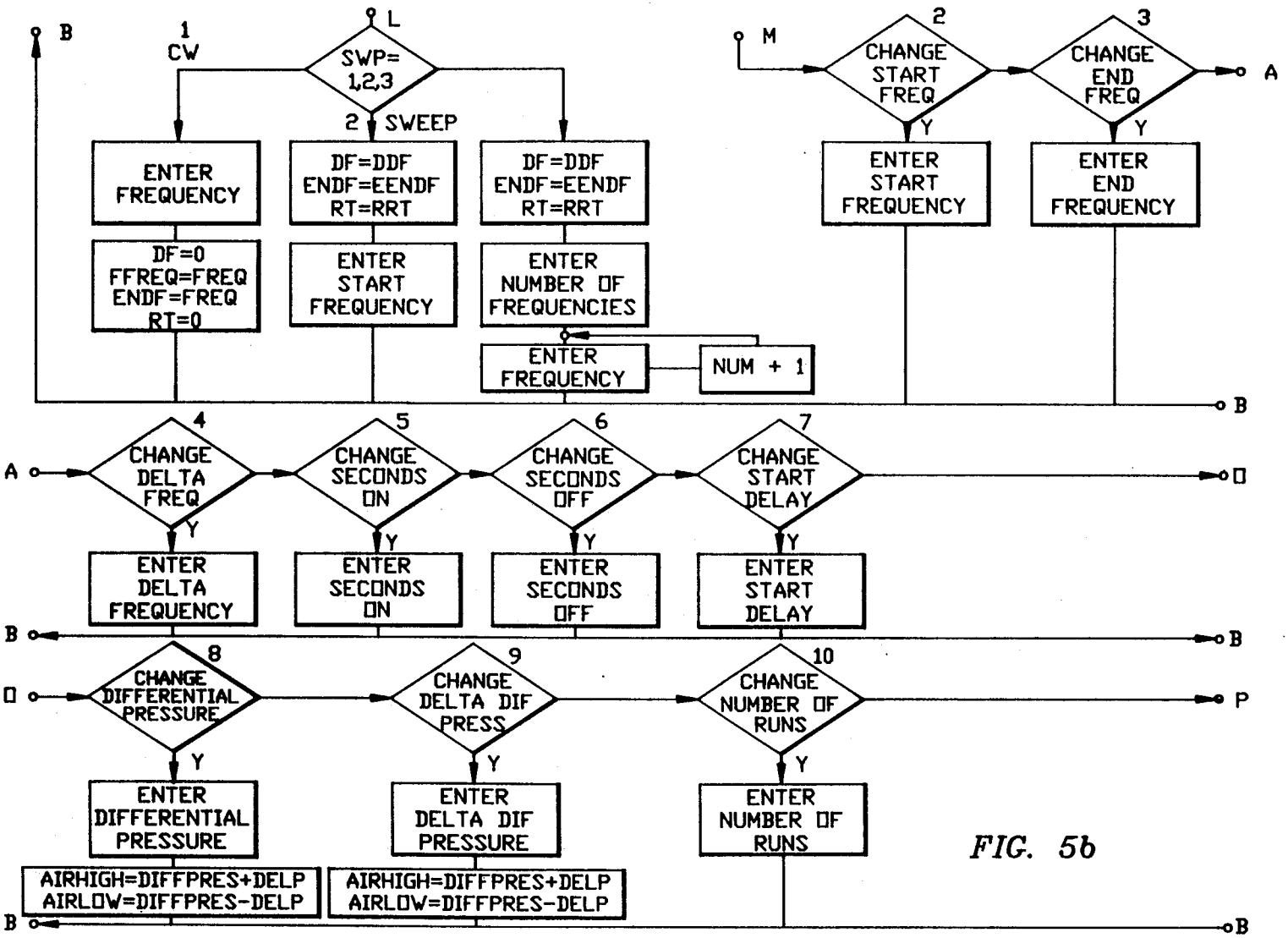
Figure 5C:
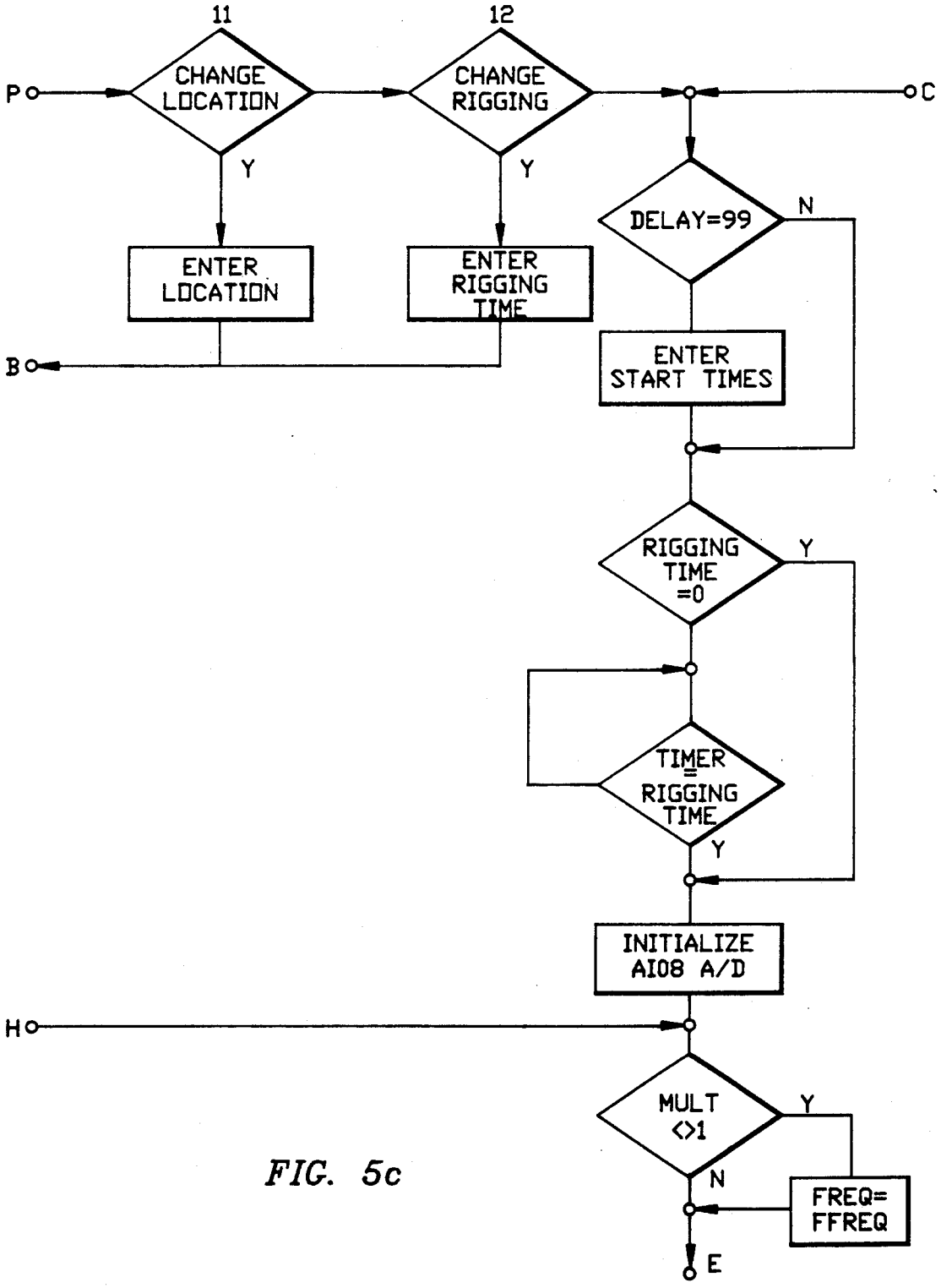
Figure 5D:
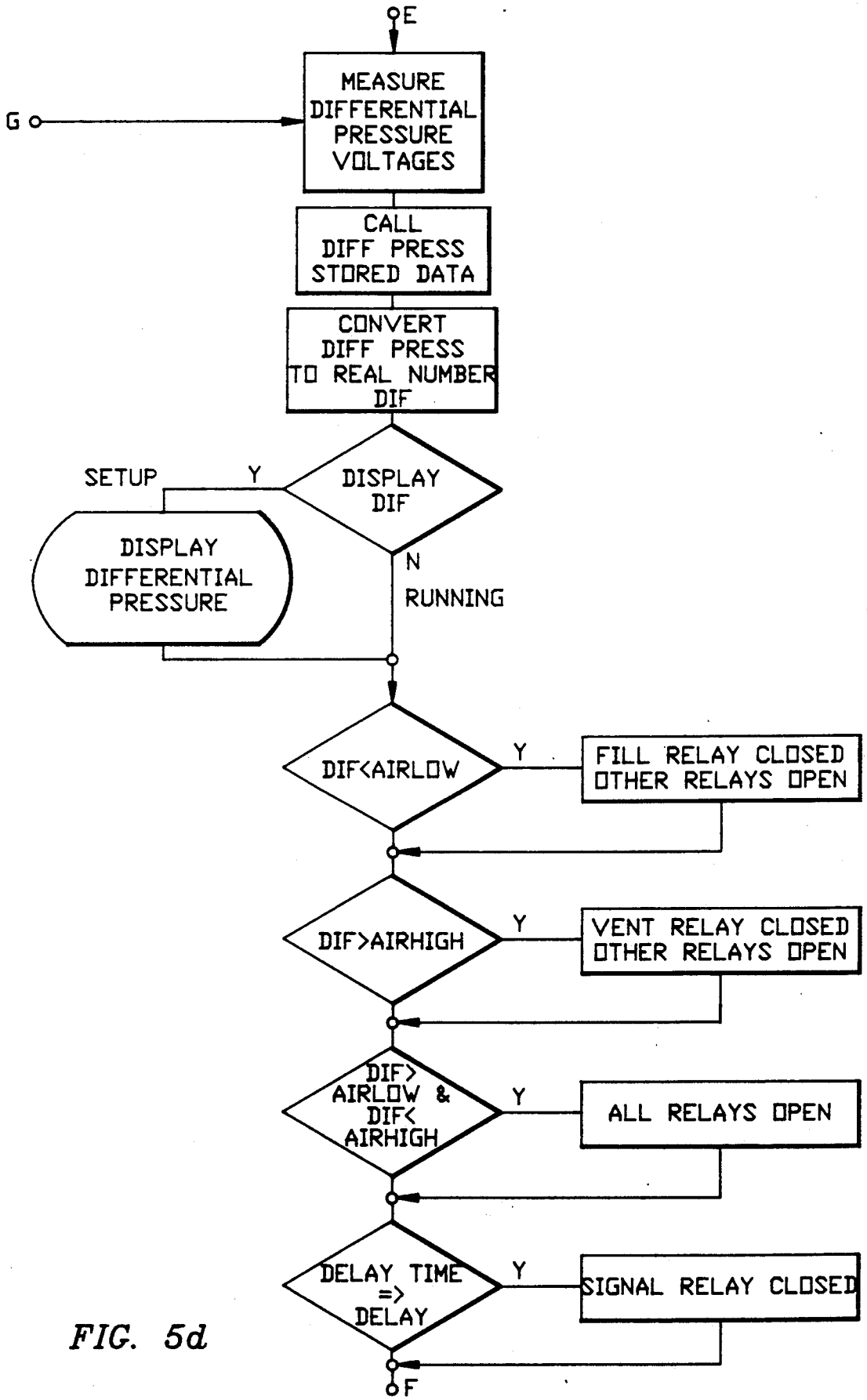
Figure 5E:
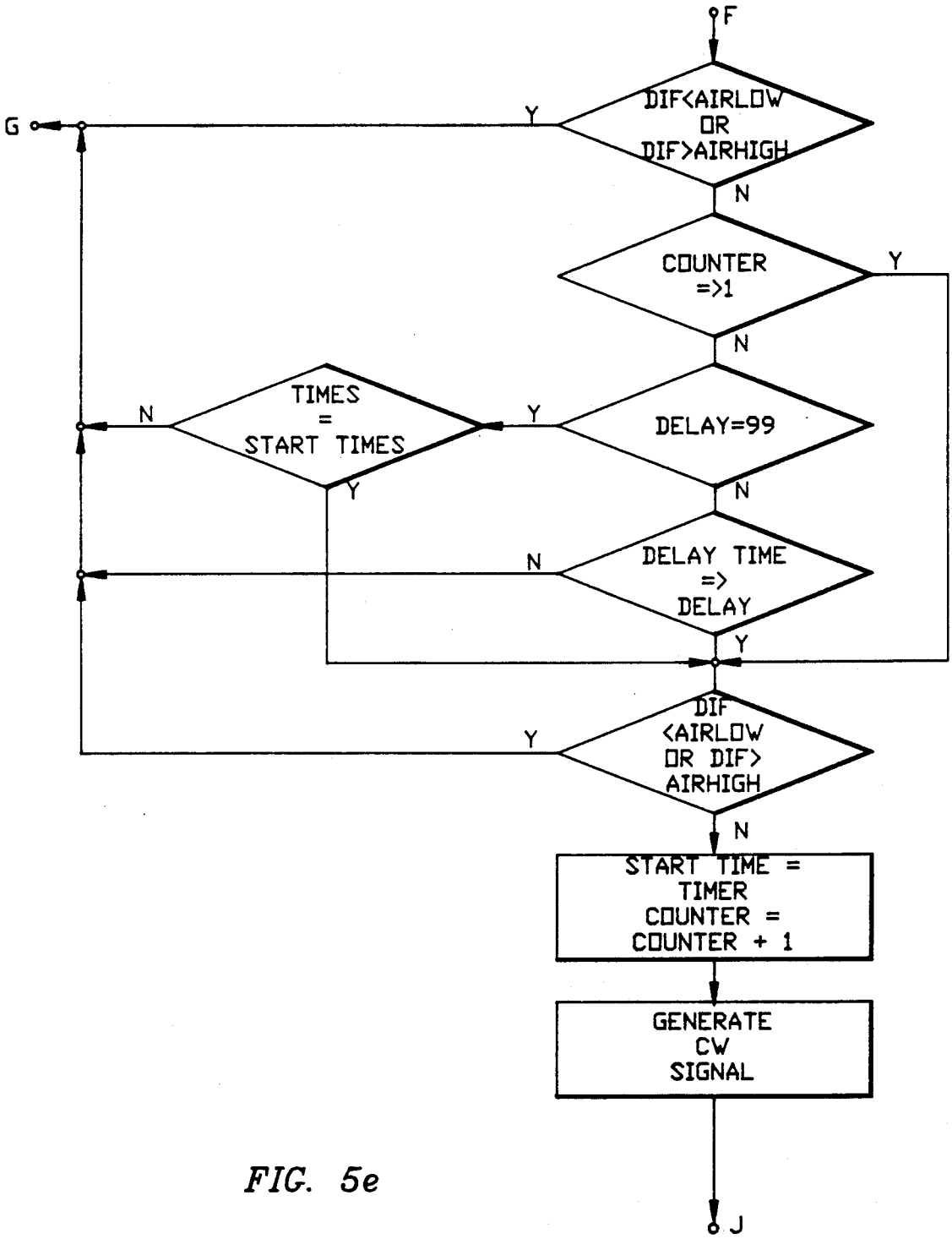
Figure 5F:
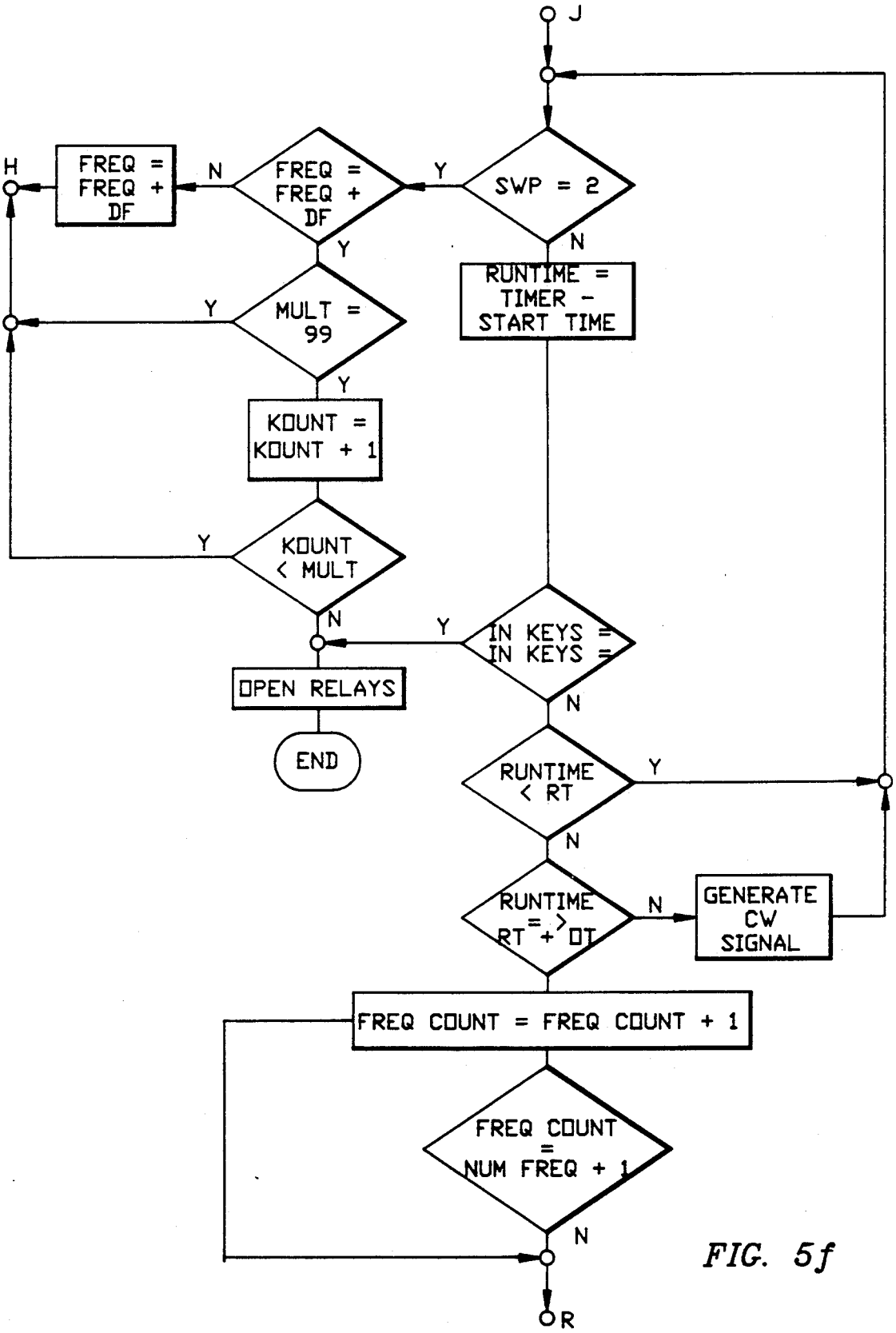
Figure 5G:
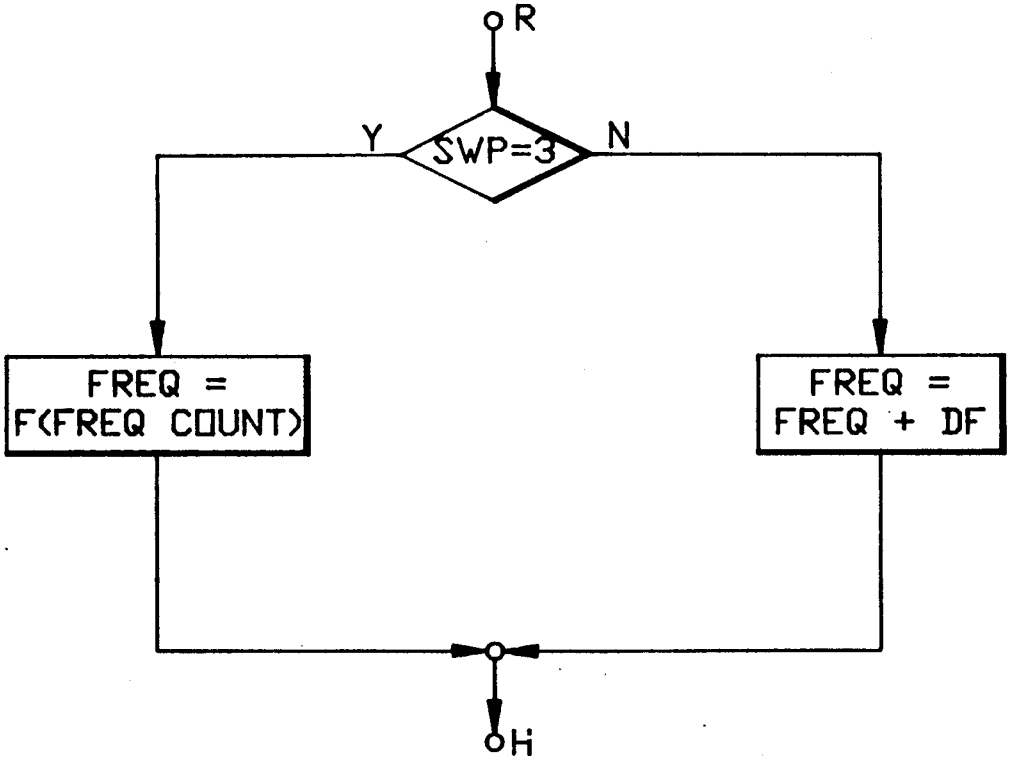

Referring now to FIGS. 1, 3 and 4, electrical connection between the components will now be described. As shown in FIG. 1, the housing 4 has disposed therein a plurality of electrical storage batteries 60 providing a twelve volt DC voltage source. The batteries 60 are electrically connected to other circuit components through an on/off switch 62 and a mercury tilt switch 64. In order for the sound source 2 to operate, the on/-off switch must be placed in the "on" position and the unit must be oriented in a generally vertical position such that the tilt switch 64 assumes a power-on position. Tilting the unit to a generally horizontal position causes the tilt switch 64 to assume a power off position whereby the unit is deactivated.

The relay board 48 includes three twelve volt relays 66, 68 and 70, which operate the power amplifier 54, the fill solenoid 32 and the vent solenoid 34, respectively. A five volt voltage regulator 72 and an eight volt voltage regulator 74 are further provided to regulate the operating voltage provided to the computer 40 and the differential pressure sensor 36, respectively. The mini-backplane 42 and the circuit board 46 are both powered by a twelve volt operating voltage.

The computer 40 preferably includes dual D-27011 paged Eproms which contain control programs and routines to boot and start the computer. The computer 40 is programmed to control all operations of the fill and vent solenoids 32 and 34, the differential pressure sensor 36 and the power amplifier 54. Considering the air fill, vent and pressurization system, high pressure air from the 3,000 psi air tank 26 is passed through the hand valve 29 and into the dome loaded differential pressure regulator 28. From there the air is admitted to the lower housing section 4a through the air feed-through 30 and the nominally closed fill solenoid 32, until the differential pressure between the inside and outside is near three psi. This pressure is measured by the differential pressure sensor 36, which outputs a voltage that is received by the analog digital convertor 50 on the circuit board 46, located on the mini-backplane 42. The voltage, representing the pressure differential, is converted and fed to the computer 40, where the decision is made, in response to the pressure differential signal, to continue to fill, to stop filling or to vent the excess pressure through the vent solenoid 34 and vent passage 35 to the outside of the housing 4. By controlling a three psi±two psi differential pressure, good stability of the air diaphragm 16 will be maintained during launch and retrieval (if desired), and in seas up to seven feet high.

To fill the lower housing section, the computer 40 produces a fill signal, which is fed to the relay board 48 to close the relay 68, thereby activating the solenoid 32. The lower housing is vented when the computer 40 provides a vent signal to the relay board which closes the relay 70 and activates the vent solenoid 34. The computer produces these signals as needed in response to the pressure differential signal indicating a pressure differential between the ambient and internal environments of greater than three psi.

To stabilize the unit 2 in its underwater environment, additional weight can be added to the unit, either on the outside or internally, replacing one or more of the batteries 60.

Considering now the acoustic system, the computer 40 generates the acoustic drive signal as a square wave having a computer-determined or preset frequency, which in turn is converted to an analog signal by D/A 51. The converted signal is sent through the low pass filter 55, the power amplifier 54 and the loudspeaker 14 for output into the water via the net covered bladder 16. The relay 66 is used to turn on the power amplifier 54 after it has been determined by the computer 40 that all delays have been satisfied and that the differential pressure setting matches the preset condition.

A particular advantage of the underwater sound source 2 is to programmably control the stated functions and to provide an expendable low frequency, high power underwater acoustic source. Enhanced flexibility is achieved using computer pre-programming and the selection of parameters which will direct the computer to operate the unit in selected modes. Thus, the computer 40 can be programmed to delay turn-on during rigging time. Alternatively, the computer 40 can be programmed to delay turn-on for a fixed time delay or until a given time to start. Activation of the acoustic system may also be delayed until the unit has reached a predetermined depth and differential pressure setting. The computer 40 may also be programmed to generate a CW frequency, step through a set of preset frequencies or run a frequency sweep. Moreover, the computer can vary the signal on-time, signal off-time and frequency increments during linear sweeps. Programming may also be provided to allow adjustment of the differential pressure setting and allowable range of differential pressure.

FIG. 5 is a block flow diagram of a computer program which may be entered into the computer 40 for controlling the underwater sound source 2 to perform the above described functions. Also illustrated in Appendix A hereto is a program listing setting forth a control program in accordance with the flow diagram of FIG. 5. The control program operates in a laboratory mode and in an operational mode. The program can also be selected to operate in an interactive display mode, or without a display.

Referring now to FIG. 5 and Appendix A, the control program initially controls the relays 66, 68 and 70 to assume an open, power-off state. In all modes, the program commences an initialization sequence to initialize the data to be used. The initialized operating variables utilized by the program are: 1) the starting frequency of the acoustic transmission, 2) the ending frequency, 3) the delta frequency, 4) the signal duration in seconds, 5) the signal off time in seconds, 6) the signal start delay in seconds, 7) the wait delay for rigging in seconds, 8) the sweep mode, i.e., CW, sweep, frequency sets, 9) the intended area of use, i.e., tank or ocean, 10) the nature of the water, i.e., fresh or salt, 11) the expendable sound source unit number, 12) the hydrophone number, 13) the hydrophone can number, 14) the number of sweeps, 15) the differential pressure, 16) the delta differential pressure, 17) the minimum and maximum differential pressures, and 18) the start time.

An interactive display mode is illustrated in which the program is installed in a conventional computer with a CRT and alphanumeric keyboard. This mode is for checkout and evaluation and is not normally used when the program is resident in the computer 40 of the expendable sound source, although it is possible that interaction may be desirable if the source is employed in a vessel-controlled configuration.

If the interactive display mode has been selected, a menu display sequence is activated and the initialization data is displayed for selective modification. Following the selection of desired data values, or if no change in these values is desired, or if a display mode is not selected, the program enters an expendable sound source operational mode. Now, the program may be loaded into the computer 40 of the expendable sound source.

The program may be loaded in any suitable way. Preferably, once a program has been prepared for the expendable sound source's operational mode, it is compiled and linked into an Exec file. This file and other necessary files are copied onto a disk. Once the contents of the disk have been verified by testing, they can be burnt into transportable memory devices, such as EPROMS by means of an EPROM burner. Once programmed, the EPROMS are conventionally plugged into the computer 40, thereby loading their program contents into the computer.

In the operational mode, following the selected rigging wait delay, if any, the program proceeds to initialize the analog/digital converter of the circuit board 46 and commences a differential pressure measuring and comparison sequence. The program determines whether the pressure differential is less than a predetermined minimum, indicating the outside water pressure is too high. If so, the fill relay 68 is closed in order to cause the fill solenoid 32 to fill the housing 4a. If the pressure differential exceeds a predetermined maximum, indicating the internal air pressure is too high, the vent relay 70 is closed to cause the vent solenoid 34 to vent air from the housing. If the differential pressure exceeds a predetermined minimum and is less than a predetermined maximum, both the fill-and-vent relays remain open and no pressurization change is made.

The program continues to monitor the differential pressure while determining whether a selected signal delay time or selected start time indicate a signal start condition. If so, the signal relay 66 is closed and audio signal generation commences in accordance with the selected sweep mode. The program periodically monitors the differential pressure and controls the fill and vent solenoids to maintain the sound source within the desired differential pressure range. The audio signal continues for the selected signal duration, and repeats if a frequency set sweep mode was selected.

APPENDIX A

Navy Case No. 72,071

```
10  ***********************************************************************
20  *                                                                     *
30  **                                                                   **
40  ***      XSS (eXpendable Sound Source)    ^^   Joe Percy    10/11/88 ***
50  **                                                                   **
60  *                                                                     *
70  ***********************************************************************
80  'SAVE"XSS".A      'C:\BASCOMP\BUOY\ & C:\BASIC\AIO8
90
100 '***********************************************************************
110 '*    NOADDRESS  = 0 -- NORMAL LAB WORK, 1 -- BUOY SYSTEM (TO COMPILE)  *
120 '*    NODISPLAY  = 0 --          "       , 1 --   "       "            *
130 '***********************************************************************
140 '
150 '
160                       NOADDRESS = 1
170 '
180 '
190 '*****************************************************************
195 OUT 768,0
200 IF NOADDRESS = 1 THEN NODISPLAY = 1 : GOTO 290
210 CLEAR, 49152!
220 DEF SEG=0
230 SG=PEEK(&H510) + 256*PEEK(&H511) + 49152!/16
240 DEF SEG = SG
250 BLOAD "AIO8.BIN", 0
260 '*****************************************************************
270 '
280 '
290                       NODISPLAY = 1
300
310 '
320 '*****************************************************************
330 IF NODISPLAY = 1 THEN 350
340 SCREEN 0,0,0:WIDTH 80:COLOR 14,1,1:CLS
350 DIM DIO%(3),DO(3),F(40)
360 '
370 '
380 IF NODISPLAY = 1 THEN 410
390 ON KEY(10) GOSUB 2020
400 KEY(10) ON
410 '
420 '
430 '*****************************************************************
440 ' Initialization of data to be used in Menu Program              *
450 FREQ = 36 : FFREQ = FREQ      ' Starting frequency                 *
460 ENDF = 96 : EENDF = ENDF      ' Ending   frequency                 *
470 DF   =  1 : DDF = DF          ' Delta    frequency                 *
480 RT   =  2 : RRT = RT          ' Signal duration in seconds         *
490 OT   =  0 : OOT = OT          ' Signal off time in seconds         *
500 DELAY=  10*60                 ' Start delay in sec (99 Timed)      *
510 WAITT = 30*60                 ' Wait delay for rigging in sec      *
520 SWP   = 2                     ' CW = 1, Sweep = 2, Set = 3         *
530 WHERE= 1                      ' Tank = 1, Ocean = 2                *
540 WATER = .4331                 ' Fresh = .4331, Salt = .4447        *
```

```
550 FNO$="XSS"                    ' XSS unit number                  *
560 HPNUM$= "1010-121"            ' Hydrophone number                *
570 CANNUM$= "SN-1"               ' Hydrophone can number            *
580 MULT = 99                     ' Number of sweeps (99=Forever)    *
590 DIFFPRES = 3!                 '                                  *
600 DELP = .5                                                        *
610 AIRHIGH = DIFFPRES + DELP     '     allowable limits             *
620 AIRLOW  = DIFFPRES - DELP     '                                  *
630 STRTIME$ = "10:42"            ' Start time hh:mm:ss              *
640 '*****************************************************************
650 '
660 IF SWP = 1 THEN DF = 0 : ENDF = FREQ'                            *
670 COUNTER = 0 : KOUNT = 0
680 IF NODISPLAY = 1 THEN 710
690 GOSUB 2150    ' ************* CALLS SOUND *****************
700 GOSUB 2190    ' ************* CALLS MENU ******************
710 IF DELAY = 99 THEN GOSUB 3950
720 IF WAITT = 0 THEN 840
730 '*************** Wait delay for rigging before start ********************
740 WAITUP = TIMER
750 WAITIME = INT(TIMER-WAITUP)
760 IF NODISPLAY = 1 THEN 820
770 LOCATE 12,25 : COLOR 12,3
780 PRINT "TIMER set for ";WAITT;" seconds"
790 LOCATE 16,25 : COLOR 15,2
800 PRINT "SECONDS to go ";WAITT-WAITIME
810 COLOR 14,1,1
820 IF WAITIME < WAITT THEN 750
830 '*****************************************************************************
840 '
850 AIO8 = 0
860 FLAG% = 0
870 MD% = 0              'initialize AIO8
880 BASADR% = &H300
890 CALL AIO8 (MD%, BASADR%, FLAG%)
900 '
910 NEWCOUNT = 0
920 ' ***************  MULTIPLE RUNS RETURN TO THIS LINE  ****************
930 '
940 IF MULT <> 1 THEN FREQ = FFREQ ' RESET FREQ TO STARTING FREQ
950  MD%=1 : D%(0)=0 : D%(1)=2           set low & hi scan limits
960  CALL AIO8 (MD%, D%(0), FLAG%)
970 '
980 '
990 ' ******************* A/D CONVERSIONS TAKE PLACE HERE *****************
1000 MD%=4        Perform single A/D, return data & increment multiplexer addre
s
1010 FOR I = 0 TO 2
1020 CALL AIO8 (MD%, D%(0), FLAG%)
1030 DIO%(I)=D%(0)
1040 IF I = 0 THEN DIFFRES = (DIO%(I)*5)/(2048)
1050 IF I = 1 THEN DEPTH   = (DIO%(I)*5)/(2048)
1060 'IF I = 2 THEN RMS     = (DIO%(I)*5)/(2048)
1070 NEXT I
1080 GOSUB 4120 ' *************** CALLS DEPTH & DIFFPRES DATA *****************
1090 'IF NODISPLAY = 1 THEN 1120
1100  GOSUB 3470    *************** CALLS SCREEN DISPLAY ********************
*
1110 '
1120   IF DIF < AIRLOW OR DIF > AIRHIGH THEN 1000
1130 '
1140 IF COUNTER = 1 THEN 1330 'Setup counter so we don't use delay more than
ce
1150 IF NEWCOUNT > 0 THEN 1200
1160 ' ~~~~~~~~~~~~~~~~~~~~~~~~~~~~~~~~~~~~~~~~~~~~~~~~~~~~~~~~~~~~~~~~~~~~~~~~
1170  GETIME = TIMER '** activate timer for delay time before starting cw sig
1180 '
1190 ' ~~~~~~~~~~~~~~~~~~~~~~~~~~~~~~~~~~~~~~~~~~~~~~~~~~~~~~~~~~~~~~~~~~~~~~~~
1200 NEWCOUNT = NEWCOUNT + 1
1210 '********************  Delay Timing Section  ************************
1220 '
```

```
1230                IF DELAY = 99 THEN GOSUB 4070 ELSE 1260
1240             IF NEWHH=HH AND NEWMM=MM AND NEWSS=SS THEN 1290
1250                          GOTO 1000
1260                   DELAYTIME = INT(TIMER - GETIME)
1270                IF DELAYTIME => DELAY THEN 1280 ELSE 1000
1280 '
1290 '*********************  End Delay Timing Section  ********************
1300 '
1310 IF NODISPLAY = 1 THEN 1330
1320 GOSUB 2150 : GOSUB 2150 : GOSUB 2150
1330  IF SWP = 1 AND COUNTER => 1 THEN 1000
1340  IF DIF < AIRLOW OR DIF > AIRHIGH THEN 1000
1350 STARTIME = TIMER '*** activate timer for cw signal duration ***
1360 COUNTER = COUNTER + 1
1370
1380
1390 ' ********************** START TO GENERATE CW SIGNAL ******************
1400 IF NODISPLAY = 1 THEN 1460
1410 GOTO 1460
1420  IF COUNTER = 1 THEN RANDOMIZE TIMER ELSE 1430
1430  F=INT(15*RND) : IF F=1 THEN 1430
1440 'B=INT( 7*RND)-1 : IF B<0 OR B=F THEN 1190
1450  COLOR  , ,F:FOR K=1 TO 100:NEXT K: COLOR 14,1,1
1460 'Set counter 2 in square wave configuration
1470 DIO%(0) = 2     'select counter 2 - 4 Mhz clock in
1480 DIO%(1) = 3      square wave generator - 4,000,000/divider = output hz
1490 '
1500 MD% = 10        'set config. mode 10
1510 CALL AIO8 (MD%, DIO%(0), FLAG%)    'do it
1520 'Now load divider
1530  DIVIDER =      7160/8
1540 IF DIVIDER > 32767 THEN DIVIDER = DIVIDER - 65536! 'correct for 2's comp.
1550 DIO%(1) = DIVIDER
1560 '
1570 '
1580 MD% = 11        'select load mode 11
1590 CALL AIO8 (MD%, DIO%(0), FLAG%)    'do it 4Mhz/1K = 4Khz
1600 '
1610 DIO%(0) = 1     'select counter 1 in cascade with counter 2
1620 DIO%(1) = 3     'square wave generator - 4Khz input freq
1630 '
1640 '
1650 MD% = 10        'set config. mode 10
1660 CALL AIO8 (MD%, DIO%(0), FLAG%)    'do it
1670 'Now load divider
1680  DIVIDER = 4000! / FREQ :DIVIDER = INT(DIVIDER+.5)
1690 IF DIVIDER > 32767 THEN DIVIDER = DIVIDER - 65536! 'correct for 2's comp.
1700 DIO%(1) = DIVIDER
1710 MD% = 11        'select load mode 11
1720 CALL AIO8 (MD%, DIO%(0), FLAG%)    'do it - 4Khz/(4Khz/freq) = freq
1730 '
1740 '
1750 IF SWP = 2 THEN IF FREQ = ENDF + DF THEN 2000
1760 '*************** Frequency Duration Timing Section  ********************
1770 '
1780                  RUNTIME =  INT(TIMER-STARTIME)
1790 '
1800 '**************  End Frequency Duration  Timing Section  ***************
1810 '
1820 IF INKEY$ = " " THEN 2020
1830 '
1840 IF RUNTIME <  RT THEN 1750
1850 IF RUNTIME => RT + OT THEN 1930
1860 'IF RUNTIME  > RT THEN 1800
1870  DIVIDER = 4000! / 20000 :DIVIDER = INT(DIVIDER+.5)'
1880 IF DIVIDER > 32767 THEN DIVIDER = DIVIDER - 65536! 'correct for 2's comp.
1890 DIO%(0)=1:DIO%(1) = DIVIDER
1900 MD% = 11        'select load mode 11
1910 CALL AIO8 (MD%, DIO%(0), FLAG%)    'do it - 4Khz/(4Khz/freq) = freq
1920 GOTO 1750
1930   FREQCOUNT = FREQCOUNT + 1
1940   IF FREQCOUNT = NUMFREQ+1 THEN FREQCOUNT=1
```

```
1950   IF SWP = 3 THEN FREQ = F(FREQCOUNT) ELSE FREQ=FREQ+DF
1960   STARTIME=TIMER
1970 IF NODISPLAY = 1 THEN 1990
1980   GOSUB 2150
1990   GOTO 1000
2000 IF MULT=99 THEN  920 ELSE KOUNT=KOUNT+1:IF KOUNT < MULT THEN 920
2010 '
2020 'Now load divider and get out of here !!!
2030 IF NODISPLAY = 1 THEN 2050
2040 GOSUB 2150
2050  DIVIDER = 40000! / 20000 :DIVIDER = INT(DIVIDER+.5)
2060 IF DIVIDER > 32767 THEN DIVIDER = DIVIDER - 65536! 'correct for 2's comp.
2070 DIO%(0)=1:DIO%(1) = DIVIDER
2080 MD% = 11        'select load mode 11
2090 CALL AIO8 (MD%, DIO%(0), FLAG%)   'do it - 4Khz/(4Khz/freq) = freq
2100 OUT 768,0
2110 IF NODISPLAY = 1 THEN 2130
2120 CLS : LOCATE 15,30 : PRINT "RELAYS OPEN"
2130 END
2140 '
2150 FOR I = 37 TO 6037 STEP 250
2160 SOUND I,.3
2170 NEXT I
2180 RETURN
2190 '*****************   MENU PRINTING SUBROUTINE   *********************
2200 CLS
2210 PRINT : PRINT
2220 PRINT TAB(9) "////////////   Percy's Expendable Bubble Source   \\\\\\\\\\\
2230 PRINT TAB(9) "*****************************************************************
2240 PRINT TAB(9) "*     ITEM                          VALUE         TO CHANGE
2250 PRINT TAB(9) "*-----------------------------------------------------------------
2260 PRINT TAB(9) "*
2270  IF SWP = 1 THEN PRINT TAB(9) "*   SINGLE FREQUENCY" TAB(40);
2280  IF SWP = 2 THEN PRINT TAB(9) "*   SWEEP FREQUENCIES" TAB(40);
2290  IF SWP = 3 THEN PRINT TAB(9) "*   SET OF FREQUENCIES" TAB(40);
2300 PRINT "                    1          *"
2310 PRINT TAB(9) "*   START FREQUENCY" TAB(40);
2320 PRINT USING  "####";FREQ;
2330 PRINT " Hz                2          *"
2340 PRINT TAB(9) "*   END FREQUENCY" TAB(40);
2350 PRINT USING  "####";ENDF;
2360 PRINT " Hz                3          *"
2370 PRINT TAB(9) "*   DELTA FREQUENCY" TAB(40);
2380 PRINT USING  "####";DF;
2390 PRINT " Hz                4          *"
2400 PRINT TAB(9) "*   SIGNAL ON TIME" TAB(40);
2410 PRINT USING  "####";RT;
2420 PRINT " Sec               5          *"
2430 PRINT TAB(9) "*   SIGNAL OFF TIME" TAB(40);
2440 PRINT USING  "####";OT;
2450 PRINT " Sec               6          *"
2460 PRINT TAB(9) "*   START DELAY (99 for time)" TAB(40);
2470 PRINT USING  "####";DELAY;
2480 PRINT " Sec               7          *"
2490 PRINT TAB(9) "*   DIFFERENTIAL PRESSURE" TAB(40);
2500 PRINT USING  "##.#";DIFFPRES;
2510 PRINT " Psi               8          *"
2520 PRINT TAB(9) "*   DELTA DIFF PRESSURE" TAB(40);
2530 PRINT USING  "  .#";DELP;
2540 PRINT " Psi               9          *"
2550 PRINT TAB(9) "*   NUMBER OF RUNS " TAB(40);
2560 PRINT USING  "  ##";MULT;
2570 PRINT "                  10          *"
2580   IF WHERE = 1 THEN PRINT TAB(9) "*   TANK " TAB(44);
2590   IF WHERE = 2 THEN PRINT TAB(9) "*   OCEAN" TAB(44);
2600 PRINT "                  11          *"
2610 PRINT TAB(9) "*   PEBS ID NUMBER" TAB(41);
2620 PRINT PNO$;
2630 PRINT "                  12          *"
2640 PRINT TAB(9) "*   HYDROPHONE NUMBER" TAB(36);
2650 PRINT HPNUM$;
2660 PRINT "                  13          *"
```

```
2670 PRINT TAB(9) "*   HYDROPHONE CAN NUM" TAB(40):
2680 PRINT CANNUM$:
2690 PRINT "                14          *"
2700 PRINT TAB(9) "*   RIGGING WAIT TIME " TAB(40):
2710 PRINT USING "####":WAITT:
2720 PRINT " Sec            15          *"
2730 PRINT TAB(9) "*
2740 PRINT TAB(9) "*-------------------------------------------------------------
2750 PRINT TAB(9) "*        MAKE CHANGE OR PRESS RETURN TO START RUN
2760 PRINT TAB(9) "*****************************************************************
2770 CHNG = 0
2780 LOCATE 24,33:INPUT "Number ===>>",CHNG
2790 IF CHNG = 0 THEN CLS  : RETURN
2800 IF CHNG = 1 THEN CLS  : LOCATE 15,10 ELSE 2930
2810 INPUT "ENTER FOR SINGLE FREQ = 1; SWEEP = 2; SET = 3 ";SWP
2820 IF SWP = 1 THEN CLS :LOCATE 15,10:INPUT "ENTER CW FREQUENCY ";FREQ
2830 IF SWP = 1 THEN DF = 0 ELSE DF = DDF
2840 IF SWP = 1 THEN FFREQ = FREQ : ENDF = FREQ ELSE ENDF = EENDF
2850 IF SWP = 1 THEN RT = 0 ELSE RT = RRT
2860 IF SWP = 3 THEN CLS :LOCATE 15,10:INPUT "ENTER NUMBER OF FREQUENCIES ";NU
REQ : ELSE 2920
2870 CLS : FOR I = 1 TO NUMFREQ
2880 LOCATE 15+I,20
2890 PRINT I;
2900 INPUT "ENTER FREQUENCY ";F(I)
2910 NEXT I
2920 GOTO 2200
2930 IF CHNG = 2 THEN CLS  : LOCATE 15,10 ELSE 2980
2940 INPUT "ENTER START FREQUENCY ";FREQ
2950 FFREQ = FREQ
2960 IF SWP = 1 THEN ENDF = FREQ ELSE ENDF = EENDF
2970 GOTO 2200
2980 IF CHNG = 3 THEN CLS : LOCATE 15,10 ELSE 3020
2990 INPUT "ENTER END FREQUENCY ";ENDF
3000 EENDF = ENDF
3010 GOTO 2200
3020 IF CHNG = 4 THEN CLS : LOCATE 15,10 ELSE 3060
3030 INPUT "ENTER DELTA FREQUENCY ";DF
3040 DDF = DF
3050 GOTO 2200
3060 IF CHNG = 5 THEN CLS  : LOCATE 15,10 ELSE 3100
3070 INPUT "ENTER NUMBER OF SECONDS ON ";RT
3080 RRT = RT
3090 GOTO 2200
3100 IF CHNG = 6 THEN CLS  : LOCATE 15,10 ELSE 3140
3110 INPUT "ENTER NUMBER OF SECONDS OFF ";OT
3120 OOT = OT
3130 GOTO 2200
3140 IF CHNG = 7 THEN CLS : LOCATE 15,10 ELSE 3170
3150 INPUT "ENTER START DELAY IN SECONDS ";DELAY
3160 GOTO 2200
3170 IF CHNG = 8 THEN CLS : LOCATE 15,10 ELSE 3220
3180 INPUT "ENTER DIFFERENTIAL PRESSURE ";DIFFPRES
3190 AIRHIGH = DIFFPRES + DELP    '     allowable limits            *
3200 AIRLOW  = DIFFPRES - DELP    '                                 *
3210 GOTO 2200
3220 IF CHNG = 9 THEN CLS : LOCATE 15,10 ELSE 3270
3230 INPUT "ENTER DELTA DIFF PRESSURE ";DELP
3240 AIRHIGH = DIFFPRES + DELP    '     allowable limits            *
3250 AIRLOW  = DIFFPRES - DELP    '                                 *
3260 GOTO 2200
3270 IF CHNG = 10 THEN CLS : LOCATE 15,10 ELSE 3300
3280 INPUT "ENTER NUMBER OF RUNS (RUNS FOREVER=99)";MULT
3290 GOTO 2200
3300 IF CHNG = 11 THEN CLS : LOCATE 15,10 ELSE 3340
3310 INPUT "ENTER LOCATION (TANK=1, OCEAN=2) ";WHERE
3320 IF WHERE = 1 THEN WATER = .4331 ELSE WATER = .4447
3330 GOTO 2200
3340 IF CHNG = 12 THEN CLS : LOCATE 15,10 ELSE 3370
3350 LINE INPUT "ENTER PEBS ID NUMBER ";PNO$
3360 GOTO 2200
```

```
3370 IF CHNG = 13 THEN CLS : LOCATE 15.10 ELSE 3400
3380 LINE INPUT "ENTER HYDROPHONE NUMBER ";HPNUM$
3390 GOTO 2200
3400 IF CHNG = 14 THEN CLS : LOCATE 15.10 ELSE 3430
3410 LINE INPUT "ENTER HYDROPHONE CAN NUM AS 'SN-#'";CANNUM$
3420 GOTO 2200
3430 IF CHNG = 15 THEN CLS : LOCATE 15.10 ELSE 3460
3440 INPUT "ENTER RIGGING WAIT TIME IN SECONDS ";WAITT
3450 GOTO 2200
3460 RETURN
3470 '*****************************************************************
3480  IF NODISPLAY = 1 THEN 3780
3490 '
3500 IF DELAYTIME => DELAY - 1  THEN 3580
3510    LOCATE 5.25
3520    IF DELAY = 99 THEN PRINT "START AT "HH":"MM":"SS
3530    LOCATE 7.26
3540    IF DELAY = 99 THEN PRINT "TIME IS "NEWHH":"NEWMM":"NEWSS : GOTO 3590
3550    PRINT "***** DELAY ***** ";DELAY;"        ";
3560    COLOR 12.3:PRINT "[";DELAYTIME;"]" : COLOR 14.1.1
3570 GOTO 3590
3580 LOCATE 7.1 : COLOR 14.1.1 : PRINT SPC(79)
3590        LOCATE 10.25
3600 PRINT "********* DEPTH *********        DIFFERENTIAL PRESSURE"
3610        LOCATE 12.1
3620 PRINT "MEASURED VALUES";
3630 PRINT USING "######.####     ";DEPTH;
3640 PRINT "VOLTS    ";
3650 PRINT USING "######.#     ";DEPSI;
3660 PRINT "PSI    ";
3670 PRINT USING "######.####     ";DIFPRES;
3680 PRINT "VOLTS    ";
3690        LOCATE 14.1
3700 PRINT "*****************************************************************
*********"
3710        LOCATE 16.1
3720 PRINT "COMPUTED VALUES          DEPTH";
3730 PRINT USING "          #########.#    ";DEP;
3740 PRINT "FEET    "
3750        LOCATE 18.1
3760 PRINT "***     DIFFERENTIAL PRESSURE";
3770 PRINT USING "              ######.##    ";DIF;
3780 IF DIF < AIRLOW  THEN OUT 768.0 : OUT 768.4   : AIR$="FILLING"
3790 IF DIF > AIRHIGH THEN OUT 768.0 : OUT 768.128 : AIR$="VENTING"
3795 IF DIF > AIRLOW AND DIF < AIRHIGH THEN OUT 768.0  : AIR$="        "
3800 IF DIF > AIRLOW AND DIF < AIRHIGH AND DELAYTIME => DELAY
                                THEN OUT 768.1  : AIR$="        "
3810 IF NODISPLAY = 1 THEN RETURN
3820 PRINT "PSI         ";AIR$
3830  GOTO 3420
3840        LOCATE 20.1
3850 PRINT "***                 CW SIGNAL                ";
3860 'PRINT USING "             ######.###   ";RMS;
3870 'PRINT "VOLTS";
3880 COLOR 3.0:PRINT USING "###";FREQ;
3890 COLOR 14.1.1:PRINT "   Hz"
3900 '
3910 LOCATE 23.12:PRINT "**************** ";
3920 COLOR 14.4:PRINT "Press Space Bar to End";
3930 COLOR 14.1:PRINT " ****************"
3940 RETURN
3950 'PROGRAM STRTIME
3960 CLS
3970 LOCATE 15.10
3980 INPUT "ENTER START TIME AS HH:MM:SS ",STARTIME$
3990 IF STARTIME$ = "" THEN STARTIME$=STRTIME$
4000 HH = VAL(LEFT$(STARTIME$,2))
4010 IF LEN(STARTIME$)= 2 THEN MM = 0 : SS = 0 : GOTO 4050
4020 MM  = VAL(MID$(STARTIME$,4,2))
4030 IF LEN(STARTIME$)= 5 THEN SS = 0 : GOTO 4050
4040 SS  = VAL(RIGHT$(STARTIME$,2))
```

```
4050 '
4060 CLS
4070 NEWHH = VAL(LEFT$(TIME$,2))
4080 NEWMM = VAL(MID$(TIME$,4,2))
4090 NEWSS = VAL(RIGHT$(TIME$,2))
4100 'IF NEWHH<>HH AND NEWMM<>MM AND NEWSS<>SS THEN 870
4110 RETURN
4120 '
20000 'SAVE "=endata",a
20009 IF PNO$="6-1" THEN 20020
20010 IF PNO$="6-2" THEN 20070
20012 '8/30/88 DIF PRES SENSOR DATA  -- UNIT #0: ID#7  "XSS"
20013 DIF=6.30801-1.394443*DIFFRES-.2754604*DIFFRES^2+1.373899E-02*DIFFRES^3+3
678476E-02*DIFFRES^4-6.714021E-03*DIFFRES^5
20015 DEP=-130.8025+241.6354*DEPTH-112.1314*DEPTH^2+67.73583*DEPTH^3-17.70302*
PTH^4+1.683667*DEPTH^5
20019 GOTO 20110
20020 '5/10/88 DEPTH SENSOR DATA -- UNIT #1: ID# 2534
20030 '5/10/88 DIF PRES SENSOR DATA  -- UNIT #1
20040 DIF=-1.027791+2.903331*DIFFRES-1.94562*DIFFRES^2+.8444865*DIFFRES^3-.1635
1*DIFFRES^4+.0115789*DIFFRES^5
20050 DEP=-61.07687-7.474855*DEPTH+177.1838*DEPTH^2-68.84674*DEPTH^3+21.36025*
PTH^4-1.946702*DEPTH^5
20060 GOTO 20110
20070 '8/30/88 DEPTH SENSOR DATA -- UNIT #2: ID# 67
20080 '8/30/88 DIF PRES SENSOR DATA -- UNIT #2: ID# 0006
20090 DIF=6.5536-1.264401*DIFFRES-.3825334*DIFFRES^2+.1234389*DIFFRES^3-1.4745
E-02*DIFFRES^4-6.440527E-05*DIFFRES^5
20100 DEP=-26.30455+18.84953*DEPTH-3.265246*DEPTH^2+5.104406*DEPTH^3-1.249791*
PTH^4+9.991299E-02*DEPTH^5
20110 DEPSI = DEP
20120 DEP = (DEP-DIF)/WATER
20130 RETURN
```

Thus, a novel low frequency, high power underwater sound source has been disclosed. While applications and embodiments of this invention have been shown and described, it should be apparent to those skilled in the art that many more modifications are possible without departing from the inventive concepts herein. For example, structural variations could be made to better facilitate launching from aircraft, surface ship and submarine. The unit could be repackaged in different sized configurations, using fewer or more batteries, alternative diaphragm constructions, and a different power amplifier and computer or microprocessor. Modifications could also be made to the system to include other digital/analog convertors from which a variety of signal generation techniques can be used to drive the loudspeaker. Another alternative could provide communication with the unit while submerged to change preset parameters as the unit has the capability of measuring the pulse width of a TTL signal which can be converted to frequency. The invention, therefore, is not to be restricted except in the spirit of the appended claims and their equivalents.

I claim:

1. A low frequency, high powered underwater sound source comprising:

a housing; and, disposed in said housing:

a loudspeaker;

containing means for containing a pressurized non-liquid sound transmission medium adjacent said loudspeaker;

fill means for filling said sound transmission medium containing means with a sound transmission medium in response to a fill signal;

vent means for venting said sound transmission medium containing means of a sound transmission medium in response to a vent signal;

sensing means for generating a pressure differential signal representing a comparision of the pressure in said sound transmission medium containing means with an ambient underwater pressure;

signal generating means for generating an acoustic signal at said loudspeaker in response to an acoustic drive signal; and programmed control means connected to said fill means, said vent means, and said sensing means, for generating said fill signal or said vent signal in response to said pressure differential signal and connected to said signal generating means for producing said acoustic drive signal.

2. The low frequency, high powered underwater sound source of claim 1 wherein said acoustic drive signal includes a square wave of a predetermined frequency.

3. The low frequency, high powered underwater sound source wherein said signal generating means include means for converting a square wave of a predetermined frequency to an analog signal, low pass filter means for filtering said analog signal and power amplifier means for generating an acoustic signal at said loudspeaker in response to said filtering of said analog signal.

4. The low frequency, high powered underwater sound source of claim 1 wherein said signal generating means includes a power amplifier, a relay connected to said power amplifier and to said control means, said relay being activated by said control means to connect said acoustic drive signal to said power amplifier following a predetermined time delay and determination by said programmed control means that said sound transmission containing means have reached a predetermined differential pressure.

5. The low frequency, high powered underwater sound source of claim 1 wherein said acoustic drive signal includes a CW frequency.

6. The low frequency, high powered underwater sound source of claim 1 wherein said acoustic drive signal includes a set of signals with preset frequencies.

7. The low frequency, high powered underwater sound source of claim 2 wherein said acoustic drive signal includes a frequency sweep.

8. The low frequency, high powered underwater sound source of claim 7 wherein said programmed control means varies a signal on-time and a signal off-time of said acoustic drive signal and linearly sweeps the frequency of said acoustic drive signal in a plurality of linear sweeps, each of said linear sweeps including respective frequency increments.

9. The low frequency, high powered underwater sound source of claim 1 wherein said programmed control means include means for maintaining a selected pressure differential between said pressurized sound transmission medium and the ambient underwater pressure by selectively generating said fill signal or said vent signal.

10. The low frequency, high powered underwater sound source of claim 9 wherein said programmed control means further include means for selecting a range of pressure differential between said pressurized sound transmission medium and the ambient underwater pressure.

11. The low frequency, high powered underwater sound source of claim 1 wherein said programmed control means include a digital processor.

12. The low frequency, high powered underwater sound source of claim 11 wherein said programmed control means include paged Eproms containing control programs and routines to boot and start said digital processor.

13. The low frequency, high powered underwater sound source of claim 11 wherein said pressure differential sensing means include a differential pressure sensor and an analog/digital convertor connected to said differential pressure sensor.

14. The low frequency, high powered underwater sound source of claim 11 wherein said signal generating means include a digital-to-analog converter, a low pass filter connected to said digital-to-analog converter, and a power amplifier connected to said low pass filter.

15. The low frequency, high powered underwater sound source of claim 11 wherein said fill and vent means each includes a solenoid, and a relay connected to said solenoid and to said programmed control means.

16. The low frequency, high powered underwater sound source of claim 1 further including a tilt switch means for providing electrical power in said underwater sound source in response to a predetermined orientation of said underwater sound source.

17. The low frequency, high powered underwater sound source of claim 1 wherein said housing includes a first end, a second end and a central body portion disposed between said first and second ends.

18. The low frequency, high powered underwater sound source of claim 17 wherein said loudspeaker is mounted over an aperture formed at one end of said housing, and said containing means are mounted on and extend from said housing end.

19. The low frequency, high powered underwater sound source of claim 18 wherein said containing means include a resilient inflatable diaphragm covered by a net.

20. The low frequency, high powered underwater sound source of claim 1 further including a flotation device attached to said housing.

21. A low frequency, high powered underwater sound source comprising:

a housing having a first end, a second end and a central body portion disposed between said first and second ends, said first end having a loudspeaker mounting portion disposed thereon and said second end having a flotation device attachment portion;

a loudspeaker mounted within said housing at said loudspeaker mounting portion, said loudspeaker mounting portion of said housing having a loudspeaker aperture therein through which sound to be generated by said loudspeaker may be directed out of said housing;

a resilient expandable diaphragm disposed at said first housing end, over said loudspeaker aperture;

a source of pressurized gas disposed in said housing;

a fill valve operatively connected to said pressurized gas source to provide pressurized gas to said diaphragm;

a vent valve to vent pressurized gas from said diaphragm;

a differential pressure sensor for producing a pressure differential signal indicative of a comparison of the gas pressure on said diaphragm with the ambient underwater pressure;

a signal generator for generating an acoustic signal at said loudspeaker and;

a programmed controller to selectively control said fill and vent valves in response to said pressure differential signal from said differential pressure sensor, and to control the output of said signal generator.

22. The low frequency, high powered underwater sound source of claim 21 further including a differential pressure regulator, and wherein pressurized gas is provided from said pressurized gas source to said fill valve through said differential pressure regulator.

23. The low frequency, high powered underwater sound source of claim 21 wherein said housing includes at least one electrical storage device for powering said controller, said signal generator and said fill and vent valves.

24. The low frequency, high powered underwater sound source of claim 21 further including a flotation device attached to said second housing end.

* * * * *